US005635921A

United States Patent [19]

Maxwell et al.

[11] Patent Number: 5,635,921

[45] Date of Patent: Jun. 3, 1997

[54] EMERGENCY VEHICLE RADIO TRANSMISSION SYSTEM

[75] Inventors: Douglas G. Maxwell, Minneapolis; Marc L. Denis, Plymouth, both of Minn.

[73] Assignee: Midland Associates, Inc., Minneapolis, Minn.

[21] Appl. No.: 380,845

[22] Filed: Jan. 30, 1995

[51] Int. Cl.[6] ..... G08G 1/00

[52] U.S. Cl. ..... 340/902; 340/904; 340/825.03; 340/825.39

[58] Field of Search ..... 340/902, 903, 340/904, 905, 539, 825.03, 825.39, 825.54

[56] References Cited

U.S. PATENT DOCUMENTS

| | | | |
|---|---|---|---|
| 3,622,999 | 11/1971 | Getz | 340/902 |
| 3,673,560 | 6/1972 | Barsh et al. | 340/901 |
| 3,760,349 | 9/1973 | Keister et al. | 340/902 |
| 3,859,623 | 1/1975 | Koehler | 340/902 |
| 3,864,674 | 2/1975 | Worsham et al. | 340/902 |
| 3,873,963 | 3/1975 | Neal et al. | 340/902 |
| 3,947,815 | 3/1976 | Muncheryan | 340/575 |
| 4,023,043 | 5/1977 | Stevenson | 367/40 |
| 4,038,634 | 7/1977 | Caliri | 340/459 |
| 4,238,778 | 12/1980 | Ohsumi | 340/903 |
| 4,241,326 | 12/1980 | Odom | 340/333 |
| 4,363,028 | 12/1982 | Bosnak | 340/384.72 |
| 4,403,208 | 9/1983 | Hodgson et al. | 340/902 |
| 4,443,790 | 4/1984 | Bishop | 340/539 |
| 4,764,978 | 8/1988 | Argo et al. | 455/1 |
| 5,278,553 | 1/1994 | Cornett et al. | 340/902 |

*Primary Examiner*—Jeffery Hofsass
*Assistant Examiner*—Edward Lefkowitz
*Attorney, Agent, or Firm*—Nawrocki, Rooney & Sivertson, P.A.

[57] ABSTRACT

An apparatus for, and method of, providing an emergency signal over preselected frequencies of various radio bands such that the operators of nearby motor vehicles, or other emergency vehicles, or the like, may respond accordingly. The preselected frequencies may be selected to correspond to radio station frequencies, police frequencies, emergency frequencies, etc. which are active at a corresponding location. However, because the frequencies may be preselected, sensitive radio frequencies, for example those used by fire fighting units, police units and other emergency systems, may be excluded from the selection. Consistent therewith, the selected frequencies may be provided by a user, a scanner, or any other means for selecting appropriate frequencies. The power applied to the emergency signal may be adjusted such that only vehicles within a predefined range relative to the transmitting unit are affected.

21 Claims, 11 Drawing Sheets

EMERGENCY VEHICLE RADIO TRANSMISSION SYSTEM

BACKGROUND OF THE INVENTION

1. Field of the Invention

The present invention generally relates to radio transmitters and more particularly to emergency vehicle radio transmission systems.

2. Description of the Prior Art

The effectiveness of acoustical warning systems employed by emergency vehicles, trains, or the like has become increasingly problematic in recent years. In an ideal world, an emergency vehicle's acoustical warning signal, such as a siren, can be heard by nearby motorists and the motorists may respond accordingly. However, for a variety of reasons, the operators of modern vehicles may not be able to hear an acoustical warning provided by a nearby emergency vehicle or the like. First, modern automobiles are more sound proof thereby reducing the sound of an acoustical warning therein. Second, with the widespread use of vehicle air conditioning, more motorists have their windows closed thereby reducing the effectiveness of an acoustical warning system. Third, many motorists may have high performance radios installed in their vehicles, whereby the high performance radios may be operated at a relatively high volume level thereby drowning out the acoustical warning provided by a nearby emergency vehicle or the like. Any one, or a combination of the above mentioned factors, has reduced the effectiveness of acoustical warning systems.

There have been several advancements in recent years to help alleviate this problem. U.S. Pat. No. 5,278,553, issued to Cornett et al., suggests a system wherein a microphone and a sensing system are placed in each motor vehicle. The microphone is placed near the front or rear windshield and provides an electrical signal to a control block. The control block filters the electrical signal to detect a sounding siren. Once a sounding siren is detected, the control block overrides the radio receiver in the corresponding motor vehicle and provides a warble sound to the driver, indicating an approaching emergency vehicle. The system suggested by Cornett et al. may be expensive to implement because each motor vehicle must be provided with a microphone and a control block as described above. With millions of motor vehicles on the road, this could result in hundreds of millions of dollars in implementation costs.

Similar approaches are suggested in U.S. Pat. No. 3,873,963, issued to Neal et al., and U.S. Pat. No. 3,859,623, issued to Koehler.

U.S. Pat. No. 4,403,208, issued to Hodgson et al., U.S. Pat. No. 4,241,326, issued to Odom, U.S. Pat. No. 4,238,778, issued to Ohsumi, U.S. Pat. No. 3,760,349, issued to Keister et al., U.S. Pat. No. 3,673,560, issued to Barsh et al., and U.S. Pat. No. 3,710,313, issued to Kimball et al., all require additional equipment to be installed in each motor vehicle wherein the additional equipment receive signals from an emergency vehicle and provide a warning to a corresponding driver. These systems suffer from the same limitations as discussed above.

Another advancement is suggested in U.S. Pat. No. 4,443,790, issued to Bishop. In Bishop, an emergency vehicle provides a siren signal over all AM and FM band frequencies such that any radio receiver in the region, tuned to any AM or FM frequency, may receive said siren signal and provide a warning to a corresponding driver. In this approach, no additional equipment need be installed in a corresponding motor vehicle. However, Bishop suffers from a number of limitations. A first limitation is that significant power may be required to transmit over all frequencies in the AM and FM band. A second limitation is that Bishop only contemplates sweeping all AM or FM bands at a rate of 150 to 450 Hz, which severely limits the quality of the audio signal that can be provided to any given radio receiver. That is, Bishop may only provide a warning tone or equivalent to a corresponding driver.

Another system related to Bishop is described in U.S. Pat. No. 4,764,978, issued to Argo et al. Like Bishop, Argo suggests broadcasting a siren signal on each and every AM and FM frequency. However, Argo suggests broadcasting on each and every AM and FM band simultaneously. A limitation of Argo is that a significant amount of power and hardware may be required to simultaneously transmit over all frequencies in the AM and FM band.

SUMMARY OF THE INVENTION

The present invention overcomes many of the disadvantages of the prior art by providing an apparatus for, and method of, providing an emergency signal over preselected frequencies of various radio bands such that the operators of nearby motor vehicles, or other emergency vehicles, or the like may respond accordingly. The preselected frequencies may be selected to correspond to radio station frequencies, police frequencies, emergency frequencies, etc. which are active in a corresponding region. However, because the frequencies may be preselected, sensitive radio frequencies, such as those used by fire fighting units, police units and other emergency systems, may be excluded from the selection. Consistent therewith, the selected frequencies may be provided by a user, a scanner, or any other means for selecting appropriate frequencies. The power applied to the emergency signal may be adjusted such that only vehicles within a predefined range relative to the transmitting unit are affected. Finally, an illustrative embodiment of the present invention does not require any equipment to be installed in a receiving motor vehicle other than a standard AM or FM receiver.

In a first illustrative embodiment of the present invention, an audio message may be transmitted over a first one of the preselected frequencies such that all radio receivers tuned to the first one of the preselected frequencies, and within a predefined range, may receive said audio message. Once the audio message has been transmitted over the first preselected frequency, the audio message may be transmitted over a second one of the preselected frequencies. That is, the audio message may be transmitted over the preselected frequencies in a sequential manner. This may be continued until the audio message has been transmitted over all of the preselected frequencies. Finally, the entire process may be repeated, beginning with the first preselected frequency. It is contemplated that the audio message may be any audible sound including a siren sound, a warble, a spoken message, etc. Therefore, the present invention may not only warn a driver of an approaching emergency vehicle, but it may also provide instructions thereto, such as "move to the right" or "emergency".

In a second illustrative embodiment of the present invention, an audio message may be time-division multiplexed over the preselected frequencies. In this embodiment, the audio message may be sampled at a predetermined rate, which may be above the Nyquist sample rate for the audio message. The audio message may then be transmitted over the preselected frequencies at a stepping rate of at least the audio sampling rate, times the number of broadcast channels. This may be accomplished with only a single amplifier circuit per band, thereby minimizing the hardware and power requirements thereof. Further, because the illustrative embodiment only transmits to the preselected frequencies, and not all of the frequencies within the various bands, the stepping rate may be held to a reasonable level.

In an illustrative implementation of the above illustrative embodiments, an audio message may be provided to an FM and/or AM modulator thereby providing a modulated message. It is contemplated that the audio message may also be provided to a police band modulator, an emergency frequency modulator, or any other modulating device. The modulated message may then be provided to a mixer whereby a reference frequency signal may be mixed therewith. The reference frequency signal may be provided by a frequency controller wherein the frequency controller may step the reference frequency signal through a plurality of pre-mix frequencies at a predetermined rate such that the mixer provides post-mixed frequencies which correspond to the preselected frequencies.

For the first illustrative embodiment discussed above, the frequency controller may step the reference frequency signal through the plurality of pre-mix frequencies at a rate which corresponds to the duration of the audio message. This allows the entire audio message to be transmitted on a first one of the preselected frequency before transmitting the audio message on a next preselected frequency. For the second illustrative embodiment, the frequency controller may step the reference frequency signal through the plurality of pre-mix frequencies at a rate which is above the Nyquist sampling rate of the audio message. In a preferred embodiment, the audio message may be transmitted over the preselected frequencies at a stepping rate of at least the audio sampling rate, times the number of preselected frequencies. That is, the frequency controller may step the reference frequency signal through all of the plurality of pre-mix frequencies at a rate which is $\geqq 2$ times the highest frequency in the audio message. By limiting the number of frequencies to selected frequencies, the stepping rate of the frequency control can be held to a reasonable level.

The frequency controller may comprise a direct digital synthesizer which may be programmed to update the desired reference frequency signal at a predetermined rate. A direct digital synthesizer may comprise a full adder which is coupled to a reference oscillator. A controller may provide an operand which may be provided to the full adder wherein the full adder may add the operand to the present contents of the full adder. This may be repeated during each cycle of the reference oscillator. The "N" most significant bits of the full adder may be coupled to the address input of a memory device. In this configuration, the smaller the operand, the longer it will take for the "N" most significant bits to be affected. This, in effect, provides a programmable delay, which allows a variable frequency output. Finally, the data output of the memory device may be coupled to a digital-to-analog (D/A) converter. For each value of the "N" most significant bits of the full adder, the memory device may provide a different value to the D/A converter.

By properly programming the memory element, and by providing an appropriate operand to the full adder, the direct digital synthesizer may provide complex frequency combinations to a user. In the illustrative embodiment, the direct digital synthesizer may be programmed to step the reference frequency signal through the plurality of pre-mix frequencies at a predetermined rate such that the corresponding mixer provides post-mixed frequencies which correspond to the preselected frequencies. The operand may be provided by a user, a scanner, or any other selection means.

In a third illustrative embodiment, a remote on/off controller may be provided in each receiving motor vehicle. In this embodiment, a "wake-up" signal may be provided to the remote on/off controller by an emergency vehicle or the like, such that the remote on/off controller may turn on a radio receiver in a corresponding motor vehicle. It is further contemplated that the remote on/off controller may switch a radio receiver from a tape or compact disk mode to a radio mode. Finally, it is contemplated that the remote on/off controller may tune a radio receiver to one of the preselected frequencies and increase the volume of the radio receiver to an appropriate level.

The combination of the remote on/off controller with the above referenced embodiments may provide notification of an approaching emergency vehicle to each and every motor vehicle within a predefined range, despite having a corresponding radio in a turned off state or in a tape or compact disk mode.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
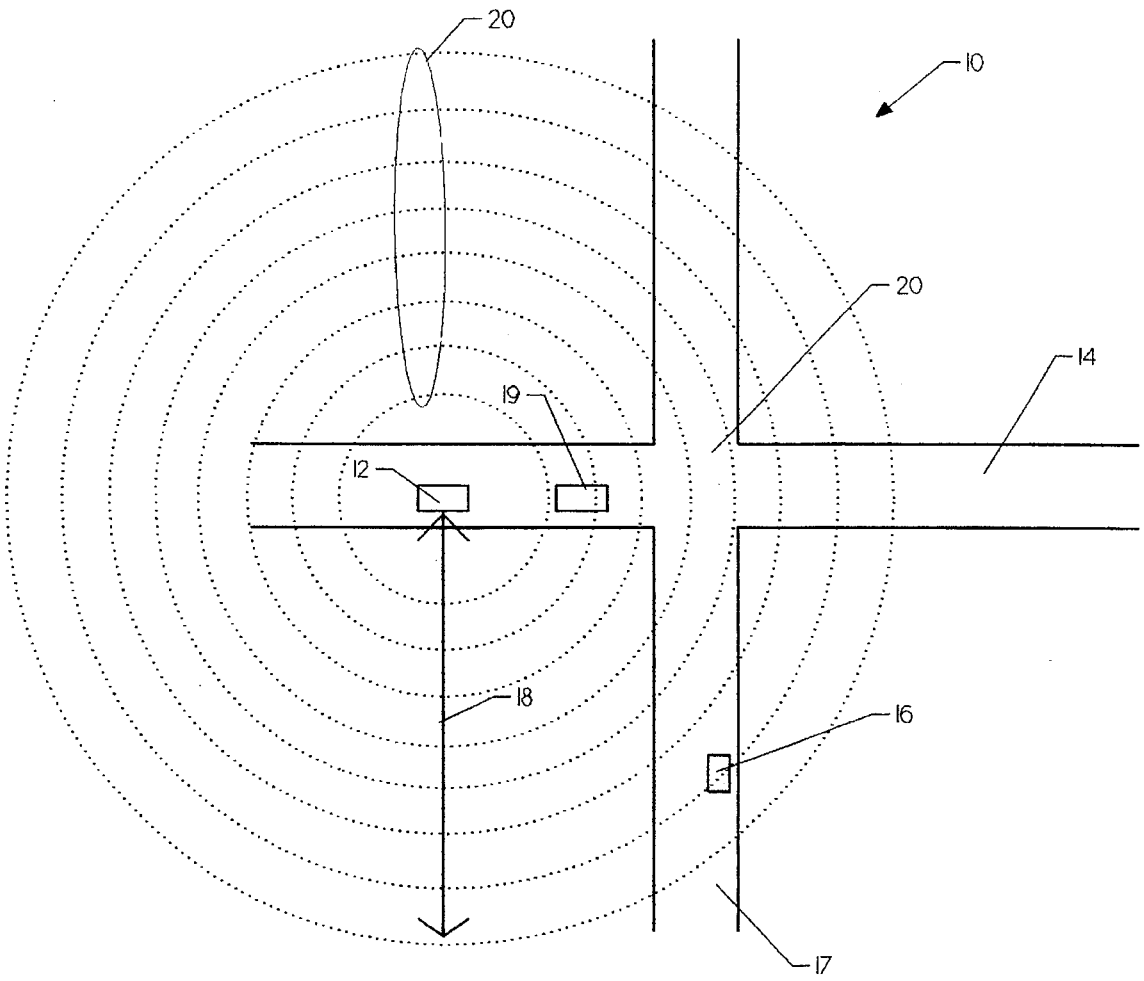
FIG. 1 is a diagram showing the general operation of the present invention.

FIG. 1 is a diagram showing the general operation of the present invention. The diagram is generally shown at 10. An emergency vehicle 12 may be driving on a first road 14 and a motor vehicle 16 may be driving on a second road 17. Emergency vehicle 12 may have an acoustical warning signal, such as a siren, to alert nearby motor vehicle operators of the approaching emergency vehicle 12. However, as stated above, the effectiveness of acoustical warning systems employed by emergency vehicles or the like has become increasingly problematical in recent years. If the operator of motor vehicle 16 does not hear the acoustical warning signal provided by emergency vehicle 12, motor vehicle 16 may collide with emergency vehicle 12 at intersection 20. Likewise, if the operator of motor vehicle 19 does not hear the acoustical warning signal provided by emergency vehicle 12, motor vehicle 19 may interfere with the progress of emergency vehicle 12 thereby increasing the response time thereof.

In response to these problems, it is recognized that motor vehicle 16 may have a radio receiver therein such that the operator of motor vehicle 16 may receive radio signals from local radio stations or the like. In the present invention, a transmitting unit may be provided in emergency vehicle 16 wherein the transmitting unit may provide radio signals for a predetermined range 18 therefrom. The radio signals are shown as radials 20. The radio signals provided by the transmitting unit may correspond to frequencies that local radio stations or the like utilize. Further, the radio signals provided by the transmitting unit may be sufficiently strong to override the corresponding radio station's signal within the predetermined range 18. In this configuration, the radio receiver in motor vehicle 16 may pick up the radio signals provided by the transmitting unit rather than a corresponding local radio station's signal.

In an illustrative embodiment of the present invention, the transmitting unit may provide an emergency signal over preselected frequencies of various radio bands such that the operator of nearby motor vehicle 16, or other emergency vehicle, or the like, may respond accordingly. The preselected frequencies may be selected to correspond to radio station frequencies, police frequencies, emergency band frequencies, etc. which are active in a corresponding location. However, because the frequencies may be preselected, sensitive radio frequencies, such as those used by fire fighting units, police units and other emergency systems, may be excluded from the selection. Consistent therewith, the selected frequencies may be provided by a user, a scanner, or any other means for selecting appropriate frequencies. The power applied to the emergency signal may be adjusted such that only vehicles within the predetermined range 18 relative to the transmitting unit are affected.

Since it is likely that the operator of motor vehicle 16 will have the radio receiver tuned to a frequency that corresponds to one of the local radio stations or the like, the operator of motor vehicle 16 may most likely receive the warning signal provided by emergency vehicle 12. To prevent the situation where a motorist has the radio receiver turned off or in a tape/compact disk mode, an illustrative embodiment of the present invention contemplates providing a remote on/off controller in motor vehicle 16. The remote on/off controller may turn on the radio receiver, or switch the radio receiver from a tape/compact disk mode into a radio mode.

In a first illustrative embodiment of the present invention, an audio message may be transmitted over a first one of the preselected frequencies such that all radio receivers tuned to the first one of the preselected frequencies, and within a predefined range, may receive said audio message. Once the audio message has been transmitted over the first preselected frequency, the audio message may be transmitted over a second one of the preselected frequencies. That is, the audio message may be transmitted over the preselected frequencies in a sequential manner. This may be continued until the audio message has been transmitted over all of the preselected frequencies. Finally, the entire process may be repeated, beginning with the first preselected frequency. It is contemplated that the audio message may be any audible sound including a siren sound, a warble, a spoken message, etc. Therefore, the present invention may not only warn a driver of an approaching emergency vehicle, but it may also provide instructions thereto, such as "Emergency—move to the right".

In a second illustrative embodiment of the present invention, an audio message may be time-division multiplexed over the preselected frequencies. In this embodiment, the audio message may be sampled at a predetermined rate, which may be above the Nyquist sample rate of the audio message. The audio message may then be transmitted over the preselected frequencies at a stepping rate of at least the audio sampling rate, times the number of preselected frequencies. This may be accomplished with only a single amplifier circuit per band, thereby minimizing the hardware and power requirements thereof. Further, because the illustrative embodiment only transmits to the preselected frequencies, and not all of the frequencies within the various bands, the stepping rate may be held to a reasonable rate.

It is contemplated that the transmitting unit may be equally applicable to trains, watercraft, airplanes, helicopters, etc. It is further contemplated that the transmitting unit may provide a directional signal, such as only toward the front and/or rear of the corresponding emergency vehicle. Finally, it is contemplated that the preselected frequencies provided by the transmitting unit may be selected from the AMband, the FM band, the police band, an emergency band, or any other radio band which is utilized locally.

Figure 2:
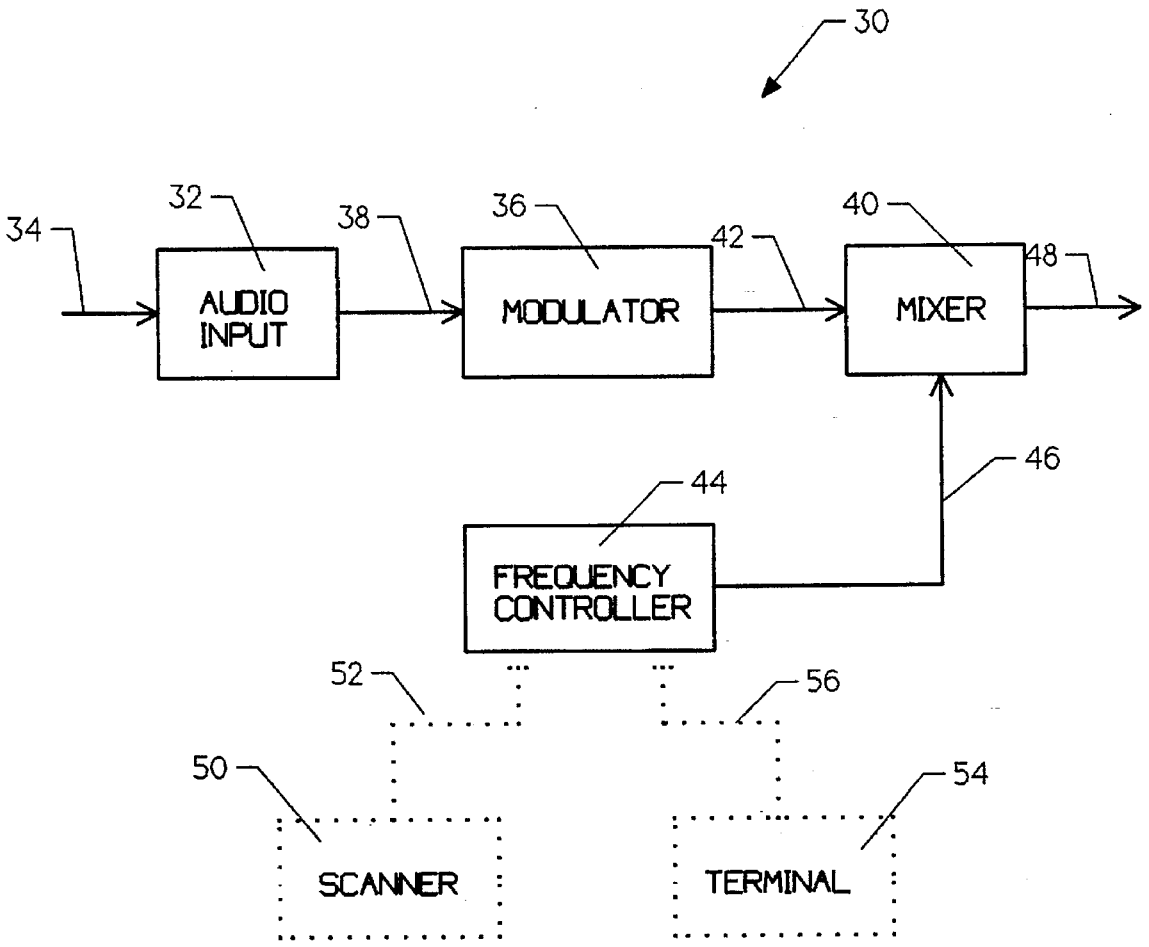
FIG. 2 is a schematic diagram showing a first illustrative implementation of the present invention.

FIG. 2 is a schematic diagram showing a first illustrative implementation of the present invention. The schematic diagram is generally shown at 30. An audio signal may be provided to an audio input block 32 via interface 34. The audio signal may be provided by a tape player, a compact disk player, a microphone, a computer means, or any other audio signal providing means. It is contemplated that the audio signal may comprise any audible sound including a siren sound, a warble, a spoken message, etc. That is, the present invention may not only warn a driver of an approaching emergency vehicle, but it may also provide an instruction thereto, such as "Emergency—move to the right".

Audio input block 32 may provide the audio signal to a modulator 36 via interface 38. Modulator 36 may be a Frequency Modulator (FM), Amplitude Modulator (AM), police band modulator, emergency band modulator, or any other modulation means. Modulator 36 may provide a modulated audio signal to a mixer 40 via interface 42. Mixer 40 may receive a reference frequency signal from a frequency controller 44 via interface 46. Mixer 40 may mix the modulated audio signal provided by modulator 36 with the reference frequency signal provided by frequency controller 44, thereby providing a post-mixed signal on interface 48.

Frequency controller 44 may step the reference frequency signal through a plurality of pre-mix frequencies at a predetermined rate such that the mixer 40 provides post-mixed signal frequencies which correspond to the above referenced preselected frequencies. In the illustrative embodiment, mixer 40 may effectively add the modulated audio signal provided by modulator 36 with the reference frequency signal provided by frequency controller 44. For example, modulator 36 may provide a modulated audio signal at a frequency of 85.6 MHz. Frequency controller 44 may step the reference frequency signal through preselected pre-mix frequencies in the range of 2.5→22.3 MHz. Mixer 40 may then provide a post-mix signal on interface 48 in the range of 88→108 MHz, and thus within the FM band. The post-mix signal may then be provided to an amplifier and/or antenna means. It is further contemplated that the amplifier and/or antenna means may provide a frequency selection function, or filtering function, such that only the sum products from mixer 40 are broadcast.

For a first illustrative embodiment discussed above, frequency controller 44 may step the reference frequency signal through the plurality of pre-mix frequencies at a rate which corresponds to the duration of the audio message. This allows the entire audio message to be transmitted on a first one of the preselected frequency before transmitting the audio message on a next one of the preselected frequency. For a second illustrative embodiment, frequency controller 44 may step the reference frequency signal through the plurality of pre-mix frequencies at a rate which is above the Nyquist sampling rate of the audio message. In a preferred embodiment, the audio message may be transmitted over the preselected frequencies at a stepping rate of at least the audio sampling rate, times the number of preselected frequencies. That is, frequency controller 44 may step the reference frequency signal through all of the plurality of pre-mix frequencies at a rate which is $\geqq 2$ times the highest frequency in the audio message, and time-division multiplex (TDM) the resulting signal over all of the preselected frequencies.

Frequency controller 44 therefore controls both the preselected frequencies and the sample rate. As stated above, the preselected frequencies may be provided by a user, a scanner, a terminal, or any other means for selecting appropriate frequencies. In the illustrative embodiment, a scanner 50 may be coupled to frequency controller 44 via interface 52. Scanner 50 may determine which frequencies in a particular location are active. It is contemplated that scanner 50 may scan the AMband, the FM band, the police band, an emergency band, or any other band which is deemed applicable.

Frequency controller 44 may also be controlled by a terminal 54. Terminal 54 may be coupled to frequency controller 44 via interface 56. Terminal 54 may be programmed to control the preselected frequencies. This may be desirable to select different preselected frequencies depending on the time of day, or any other criteria. For example, it is known that many more AMradio stations may be heard at night. This may increase the number of radio signals within a particular region. A programmed terminal may compensate for these changes. Further, a programmed terminal 54 may exclude sensitive radio frequencies, such as those used by fire fighting units, police units and other emergency systems, from the selection. Finally, it is contemplated that a user may directly control the preselected frequencies by loading in the desired frequencies into terminal 54.

Figure 3:
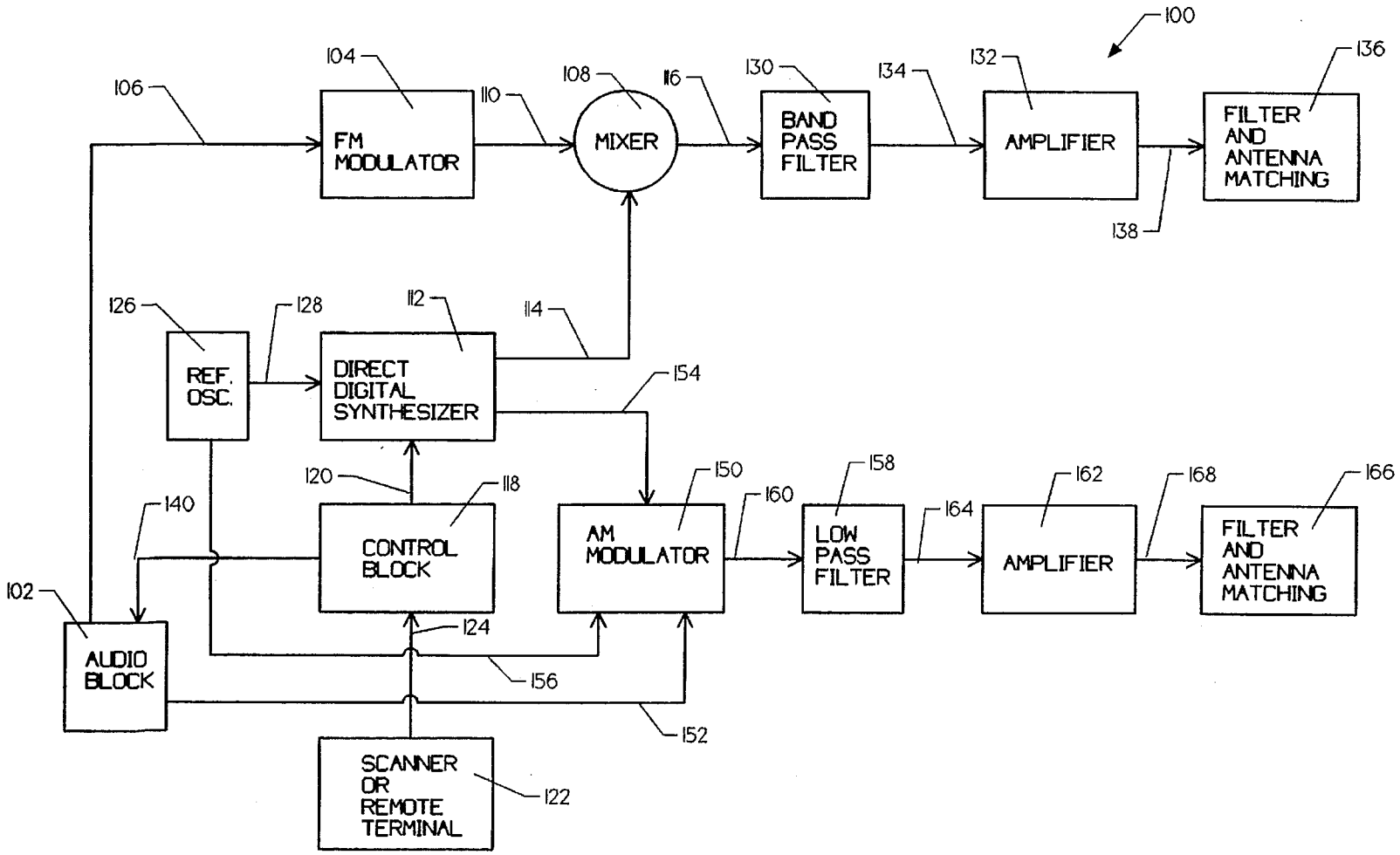
FIG. 3 is a detailed schematic diagram showing a second illustrative implementation of the present invention.

FIG. 3 is a detailed schematic diagram showing a second illustrative implementation of the present invention. The schematic diagram is generally shown at 100. In the second illustrative implementation of the present invention, and not deemed to be limiting, an audio message may be provided on preselected frequencies in the FM band and preselected frequencies in the AM band.

An audio signal may be provided to, or generated by, an audio block 102. The audio signal may be provided by a tape player, a compact disk player, a microphone, a computer means, or any other audio signal providing means. It is contemplated that the audio signal may comprise any audible sound including a siren sound, a warble, a spoken message, etc. That is, the present invention may not only warn a driver of an approaching emergency vehicle, but it may also provide an instruction thereto, such as "Emergency—move to the right".

FM TRANSMITTER

Audio block 102 may provide the audio signal to an FM modulator 104 via interface 106. The Audio signal may contain frequencies in the range of 300→3000 Hz, which corresponds to accepted audio quality for communications radio equipment. It is contemplated that FM Modulator 104 may be a standard FM modulator available off the shelf. FM Modulator 104 may provide a modulated audio signal to a mixer 108 via interface 110. In the illustrative embodiment, FM modulator 104 provides a modulated audio signal having a frequency substantially equal to 85.6 MHz. Mixer 108 may receive a reference frequency signal from a direct digital synthesizer 112 via interface 114. Mixer 108 may mix the modulated audio signal provided by FM modulator 104 with the reference frequency signal provided by direct digital synthesizer 112, thereby providing a post-mixed signal on interface 116. Mixer 108 may be an active double balanced mixer such as part number MC1596, currently available from Motorola. Direct digital synthesizer 112 may be a fully digital frequency synthesizer which uses high speed digital logic and provides a frequency change within one micro-second.

Direct digital synthesizer 112 may be coupled to a control block 118 via interface 120 and to a reference oscillator 126 via interface 128. Reference oscillator 126 may provide an accurate signal source to assure that the transmitter may operate only within FCC approved frequency bands. In the illustrative embodiment, reference oscillator 126 may provide a reference frequency of 134.2 MHz to direct digital synthesizer 112.

Control block 112 may comprise digital logic and microcontroller circuitry. Control block 112 may control the audio message playback via interface 140, the preselected pre-mix frequencies provided by direct digital synthesizer 112, and the interface between direct digital synthesizer 112 and a scanner or remote terminal block 122. The construction of the direct digital synthesizer and the control signals provided thereto is discussed with reference to FIG. 4.

In the above described configuration, direct digital synthesizer 112 may step the reference frequency signal on interface 114 through a plurality of pre-mix frequencies at a predetermined rate such that the mixer 108 provides post-mixed signal frequencies which correspond to the above referenced preselected frequencies. In the illustrative embodiment, mixer 108 may effectively add the modulated audio signal provided by FM modulator 104 with the reference frequency signal provided by direct digital synthesizer 112. It is contemplated that direct digital synthesizer may be programmed to step the reference frequency signal on interface 114 through pre-mix frequencies having a range of 2.5→22.3 MHz. In this configuration, mixer 108 may provide post-mix signal frequencies in the range from 88→108 MHz, which corresponds with the FM frequency band.

For a first illustrative embodiment discussed above, direct digital synthesizer 112 may step the reference frequency signal through the plurality of pre-mix frequencies at a rate which corresponds to the duration of the audio message. This allows the entire audio message to be transmitted on a first one of the preselected frequency before transmitting the audio message on a next one of the preselected frequency. For a second illustrative embodiment, direct digital synthesizer 112 may step the reference frequency signal through the plurality of pre-mix frequencies at a rate which is above the Nyquist sampling rate of the audio message, thereby allowing an audio message to be transmitted over all of the preselected frequencies. That is, direct digital synthesizer 112 may be programmed to step the reference frequency signal through all of the plurality of pre-mix frequencies at a rate which is ≧2 times the highest frequency in the audio message, and time-division multiplex (TDM) the resulting signal over all of the preselected frequencies. In a preferred embodiment, the audio message may be transmitted over the preselected frequencies at a stepping rate of at least the audio sampling rate, times the number of broadcast channels.

Direct digital synthesizer 112 therefore controls both the preselected frequencies and the sample rate. As stated above, the preselected frequencies may be provided by a user, scanner, terminal, or any other frequency selection means. In the illustrative embodiment, a scanner or remote terminal block 122 may be coupled to control block 118 via interface 124. Scanner or remote terminal block 122 may determine which frequencies in a particular region are active. In the illustrative embodiment, scanner or remote terminal block 122 may scan the AM band and the FM band and provide the results to control block 118.

Further, scanner or remote terminal block 122 may be programmed to control which of the preselected frequencies are selected in a particular region. This may be desirable to select different preselected frequencies depending on the time of day, or any other criteria. For example, it is known that many more AM radio stations may be heard at night. This may increase the number of radio signals within a particular region. A programmed terminal may compensate for these changes. Further, a programmed terminal may exclude sensitive radio frequencies, such as those used by fire fighting units, police units and other emergency systems, from the selection. Finally, it is contemplated that a user may directly control the preselected frequencies by loading in the desired frequencies into scanner or remote terminal block 122.

Referring back to mixer 108, mixer 108 may provide the post-mix signal having a frequency in the range from 88→108 MHz to a band pass filter block 130 via interface 116. Band pass filter block 130 may be a band pass filter which is tuned to allow frequencies in the range from 88→108 MHz to pass therethrough. Band pass filter block 130 may filter any noise outside of the FM frequency band from the post-mix signal. Band pass filter block 130 may be coupled to an amplifier 132 via interface 134. Amplifier 132 provides power gain and sufficient output power to cover the predetermined range 18. It is contemplated that the output power of FM amplifier block may be adjustable to vary the range of the FM transmitter. Finally, amplifier 132 may be coupled to a FM filter and antenna matching block 136 via interface 138. FM filter and antenna matching block 136 may provide a low pass filter function to meet FCC harmonic output restrictions for FM emissions on the FM broadcast band. FM filter and antenna matching block 136 further provides an impedance matching function between amplifier 132 and an antenna on a corresponding vehicle. It is contemplated that FM filter and antenna matching block 136 may have a switch network such that a radio installer may adjust the impedance thereof.

AM TRANSMITTER

Audio block 102 may provide the audio signal to an AM modulator 150 via interface 152. The Audio signal may contain frequencies in the range of 300→3000 Hz, which corresponds to acceptable audio quality for communications radio equipment. It is contemplated thatAM modulator 150 may be a standard AM modulator available off the shelf, such as part number MC1596 available from Motorola. Similar to above, AM modulator 150 may receive a pre-mix frequency signal from direct digital synthesizer 112 via interface 154. The frequency of the pre-mix signal may be in the range from 11.24→12.3 MHz. AM modulator 150 may further receive a fixed frequency from reference oscillator 126 via interface 156. The fixed frequency provided by reference oscillator may be substantially equal to 10.7 MHz. AM modulator 150 may amplitude modulate the audio signal provided by audio block 102 with the fixed frequency provided by reference oscillator 126. AM modulator 150 may then mix the modulated signal with the pre-mix signal provided by direct digital synthesizer 112. In the illustrative embodiment, AM modulator 150 effectively subtracts the modulated signal from the pre-mix signal and provides a post-mix signal to a low pass filter block 158 via interface 160. In the present case, AM modulator 150 may provide a post-mix signal within the frequency range of 550→1600 KHz, which corresponds to the AM frequency band.

For the first illustrative embodiment discussed above, direct digital synthesizer 112 may step the reference frequency signal through the plurality of pre-mix frequencies at a rate which corresponds to the duration of the audio message. This allows the entire audio message to be transmitted on a first one of the preselected frequency before transmitting the audio message on a next one of the preselected frequency. For a second illustrative embodiment, direct digital synthesizer 112 may step the reference frequency signal through the plurality of pre-mix frequencies at a rate which is above the Nyquist sampling rate of the audio message, thereby allowing an audio message to be transmitted over all of the preselected frequencies. That is, direct digital synthesizer may be programmed to step the reference frequency signal through all of the plurality of pre-mix frequencies at a rate which is ≧2 times the highest frequency in the audio message, and time-division multiplex (TDM) the resulting signal over all of the preselected frequencies. In a preferred embodiment, the audio message may be transmitted over the preselected frequencies at a stepping rate of at least the audio sampling rate, times the number of broadcast channels.

Direct digital synthesizer 112, therefore, controls both the preselected frequencies and the sample rate. As stated above, the preselected frequencies may be provided by a user, scanner, terminal, or any other frequency selection means. In the illustrative embodiment, a scanner or remote terminal block 122 may be coupled to control block 118 via interface 124. Scanner or remote terminal block 122 may determine which frequencies at a particular location are active. In the illustrative embodiment, scanner or remote terminal block 122 may scan the AM band and provide the results to control block 118.

Referring back to low pass filter block 158, low pass filter block 158 may provide a low pass filter function with a cut-off frequency at about 2 MHz thereby eliminating any high frequency noise provided by AM modulator 150. Low pass filter 158 may be coupled to an amplifier block 162 via interface 164. Amplifier 162 may provide power gain and sufficient output power for frequencies in the range from 540 KHz to 1600 KHz to cover the predetermined range 18. It is contemplated that the output power of amplifier 162 may be adjustable to vary the range of the AMtransmitter. Finally, amplifier 162 may be coupled to a AM filter and antenna matching block 166 via interface 168. AM filter and antenna matching block 166 may provide a low pass filter function to meet FCC harmonic output restrictions forAM emissions on the AM broadcast band. AM filter and antenna matching block 166 further provides an impedance matching function between amplifier 162 and an antenna on a corresponding vehicle. It is contemplated thatAM filter and antenna matching block 166 may have a switch network such that a radio installer may adjust the impedance thereof.

Figure 4:
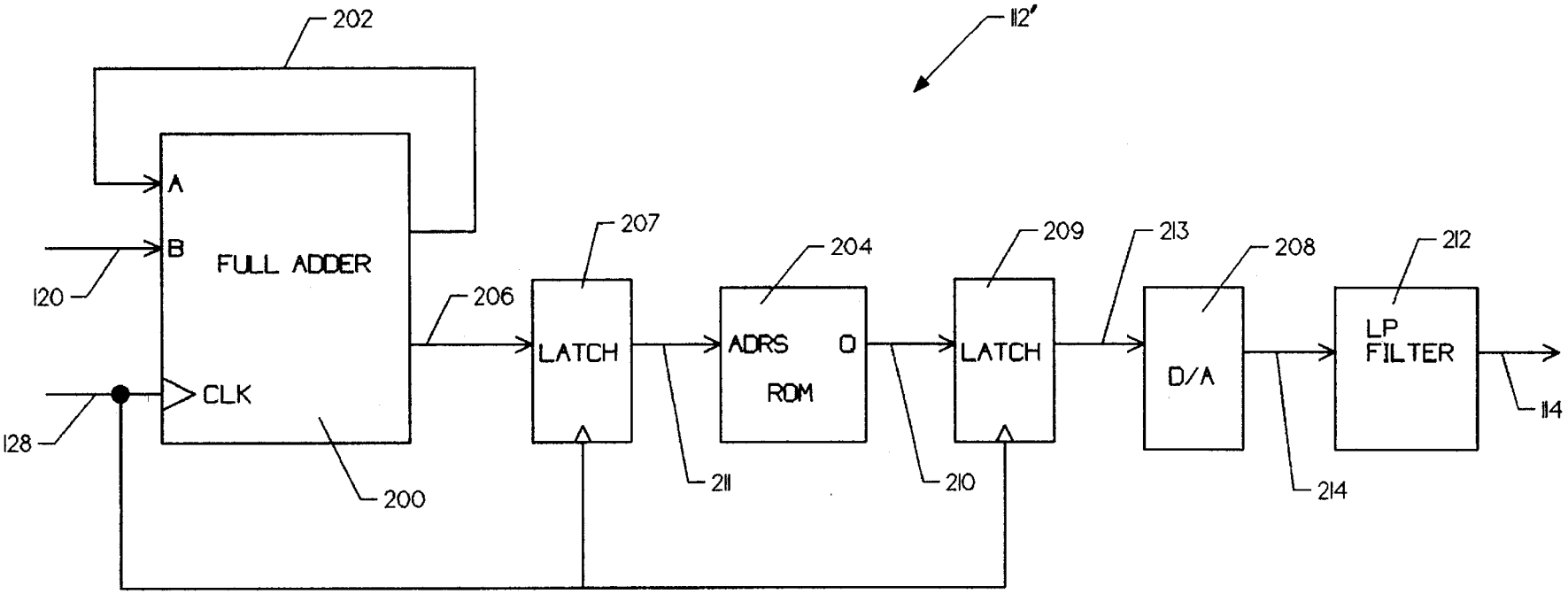
FIG. 4 is a schematic diagram of a direct digital synthesizer block as shown in FIG. 3.

FIG. 4 is a schematic diagram of a direct digital synthesizer block. The diagram is generally shown at 112' and only shows the generation of the FM pre-mix signal on interface 114. The generation of the AM pre-mix signals on interface 154 may be provided by a direct digital synthesizer which is similarly constructed.

The direct digital synthesizer block 112' may comprise a full adder 200 which may have a clock input coupled to reference oscillator 126 via interface 128. Control Block 118 may provide an operand via interface 120 which may be provided to full adder 200 wherein full adder 200 may add the operand to the present contents of full adder 200. This may be repeated during each cycle of the reference oscillator 126. The "N" most significant bits of full adder 200 may be provided to a latch 207 via interface 206. Latch 207 may be clocked via reference oscillator 126 via interface 128, or a delayed version thereof. The output of latch 207 may be coupled to the address input of a memory device 204 via interface 211. In this configuration, the smaller the operand, the longer it will take for the "N" most significant bits to be affected. This, in effect, provides a programmable delay which may be used to provide a frequency shift. Finally, the data output of the memory device 204 may be coupled to a latch 209 via interface 210. Latch 209 may be clocked by reference oscillator 126 via interface 128, or a delayed version thereof. Latch 207 and latch 209 may be included to compensate for timing variations caused by memory device 204. Without latch 207 and latch 209, the resulting radio frequency signal may have an excess of spurious noise thereon.

The output of latch 209 may be coupled to a digital-to-analog (D/A) converter 208 via interface 213. For each value of the "N" most significant bits of the full adder, memory device 204 may provide a different value to D/A converter 208. Finally, the output of D/A converter 208 may be coupled to a low pass filter block 212 via interface 214. Low pass filter block 212 may filter any high frequency noise from the output of D/A converter 208. The output of low pass frequency block 212 may be coupled to mixer 108 via interface 114.

By properly programming memory element 204, and by providing an appropriate operand to full adder 200, direct digital synthesizer 112' may provide a variety of frequencies to a user. In the illustrative embodiment, direct digital synthesizer 112' may be programmed to step the reference frequency signal through the plurality of pre-mix frequencies at a predetermined rate such that the corresponding mixer 108 may provide post-mixed frequencies which correspond to the preselected frequencies.

Figure 5:
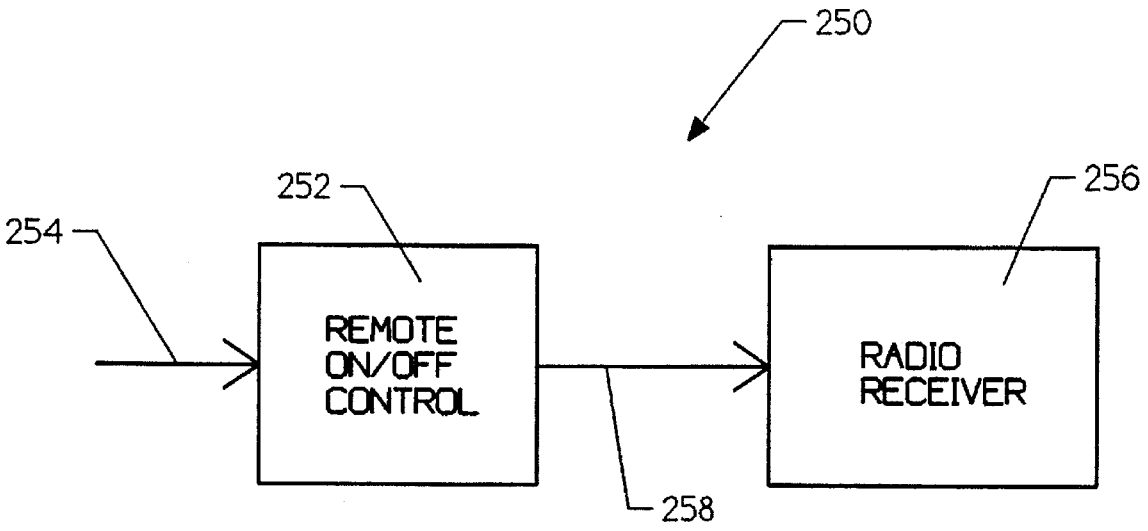
FIG. 5 is a schematic diagram showing a remote on/off controller block in conjunction with a radio receiver.

FIG. 5 is a schematic diagram showing a remote on/off controller block in conjunction with a radio receiver. The diagram is generally shown at 250. In a third embodiment of the present invention, a remote on/off controller 252 may be provided in each receiving motor vehicle. In this embodiment, a "wake-up" signal may be provided to remote on/off controller 252 by an emergency vehicle or the like via interface 254, such that remote on/off controller 252 may turn on a radio receiver 256 in a corresponding motor vehicle via interface 258. It is contemplated that interface 254 may comprise an antenna means to receive the wake-up signal provided by the emergency vehicle. It is further contemplated that remote on/off controller 252 may switch the radio receiver 256 from a tape or compact disk mode to a radio mode. Finally, it is contemplated that remote on/off controller 252 may tune the radio receiver 256 to one of the preselected frequencies and increase the volume of the radio receiver 256 to an appropriate level.

The combination of remote on/off controller 252 with the above referenced embodiments may provide notification of an approaching emergency vehicle to each and every motor vehicle within a predefined range, despite having a corresponding radio in an off state or in a tape or compact disk mode.

Figure 6:
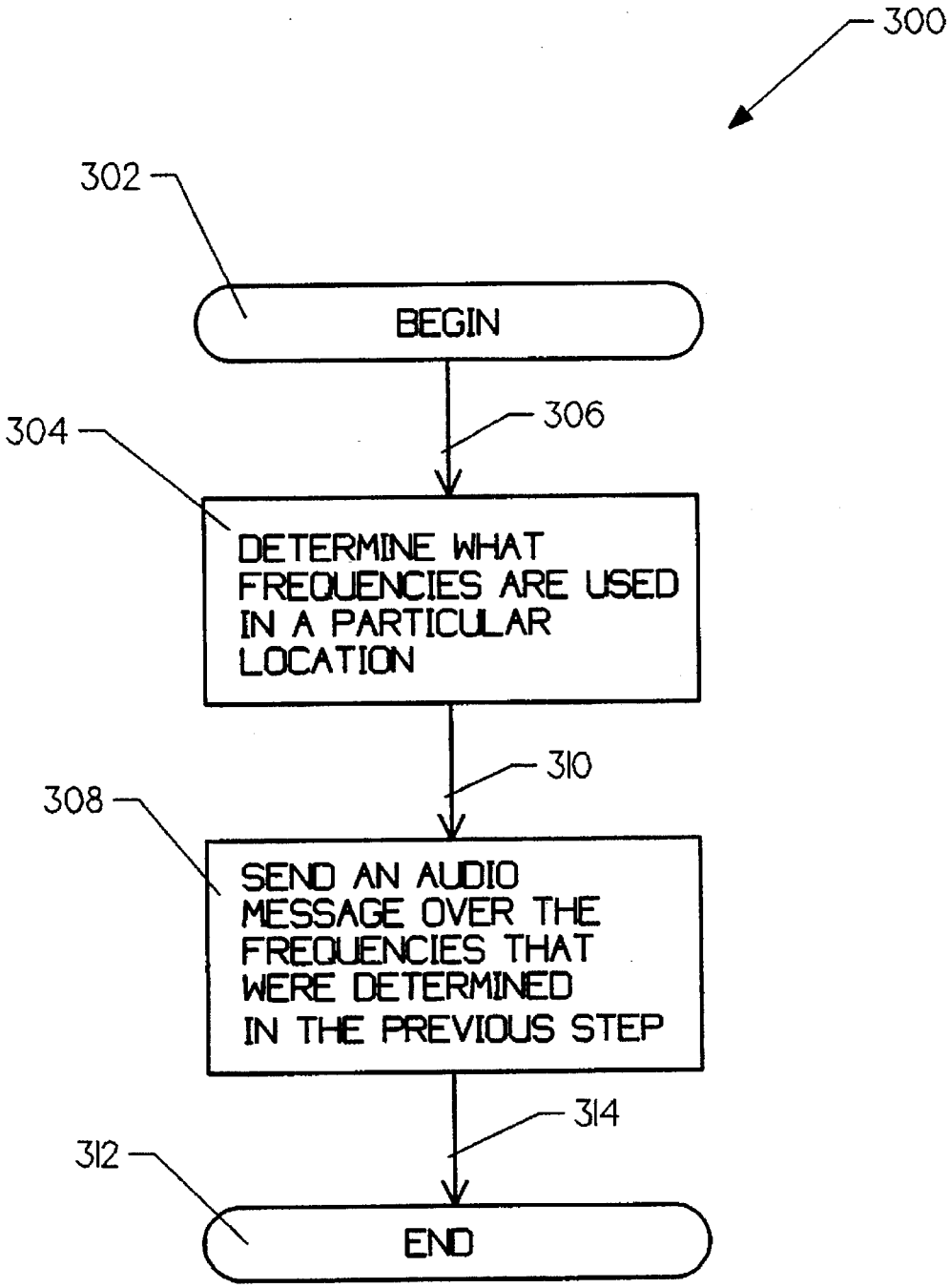
FIG. 6 is a flow diagram showing the general operation of the present invention.

FIG. 6 is a flow diagram showing the general operation of the present invention. The flow diagram is generally shown at 300. The algorithm is entered at element 302, wherein control is passed to element 304 via interface 306. Element 304 determines what frequencies are active in a particular location. Control is then passed to element 308 via interface 310. Element 308 sends an audio message over the frequencies that were determined in element 304. Control is passed to element 312 via interface 314, wherein the algorithm is exited.

Figure 7:
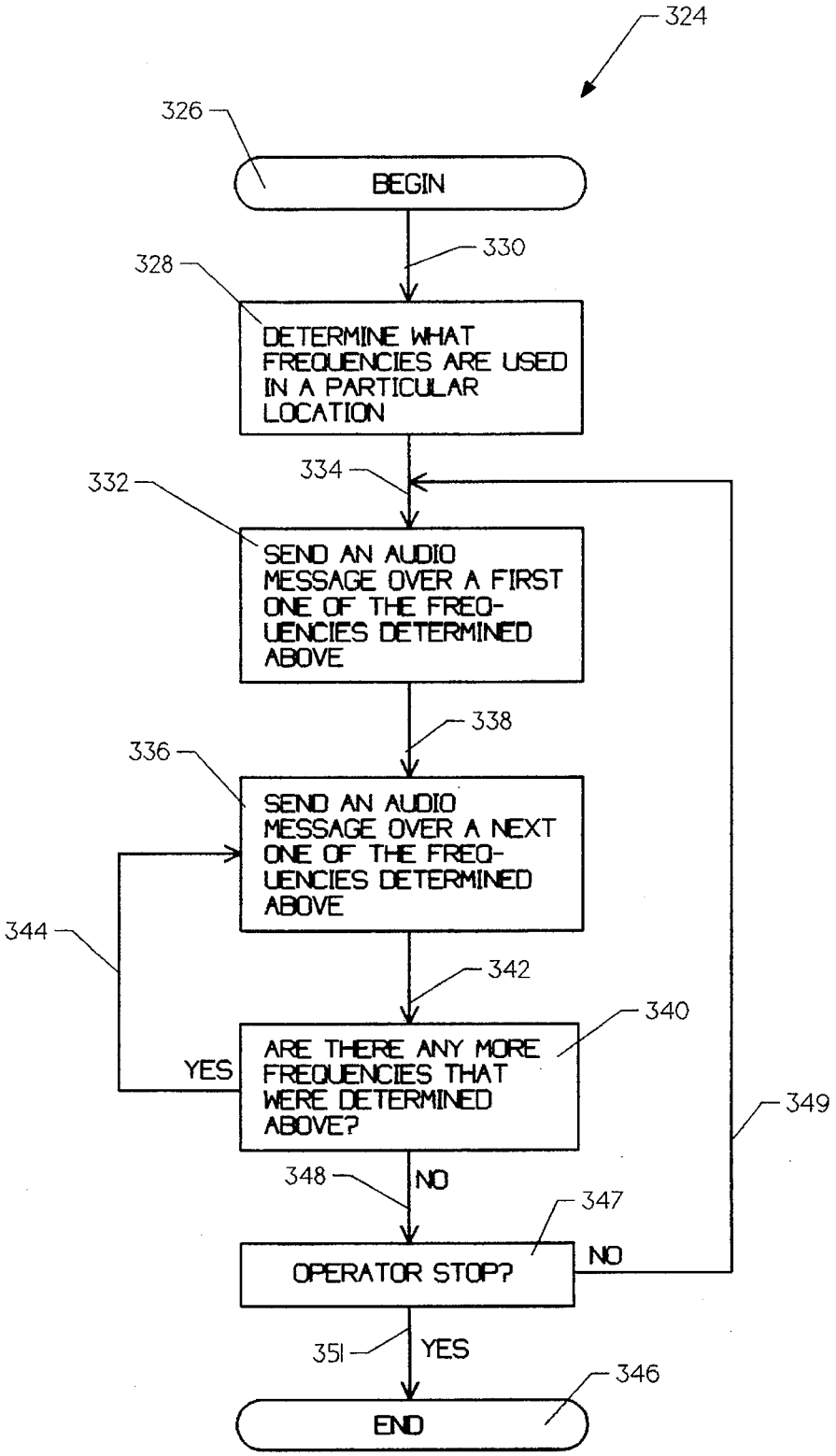
FIG. 7 is a flow diagram showing the operation of a first illustrative embodiment of the present invention.

FIG. 7 is a flow diagram showing the operation of a first illustrative embodiment of the present invention. The flow diagram is generally shown at 324. The algorithm is entered at element 326, wherein control is passed to element 328 via interface 330. Element 328 determines what frequencies are active in a particular location. Control is then passed to element 332 via interface 334. Element 332 sends an audio message over a first one of the frequencies determined in element 328. Control is then passed to element 336 via interface 338. Element 336 sends an audio message over a next one of the frequencies determined in element 328. Control is then passed to element 340 via interface 342. Element 340 determines whether there are any more frequencies that were determined in element 328. If there are more frequencies that were determined in element 328, control is passed back to element 336 via interface 344. If there are no more frequencies that were determined in element 328, control is passed to element 347 via interface 348. Element 347 determines whether an operator or the like has indicated a desire to stop the algorithm. If the operator or the like has not indicated a desire to stop the algorithm, control is passed back to element 332 via interface 349. Although it is not explicitly shown, it is also contemplated that control may be passed back to element 328, rather than element 332, wherein element 328 may determined what frequencies are used in the particular location. If the operator or the like has indicated a desire to stop the algorithm, control is passed to element 346 via interface 351, wherein the algorithm is exited.

Figure 8:
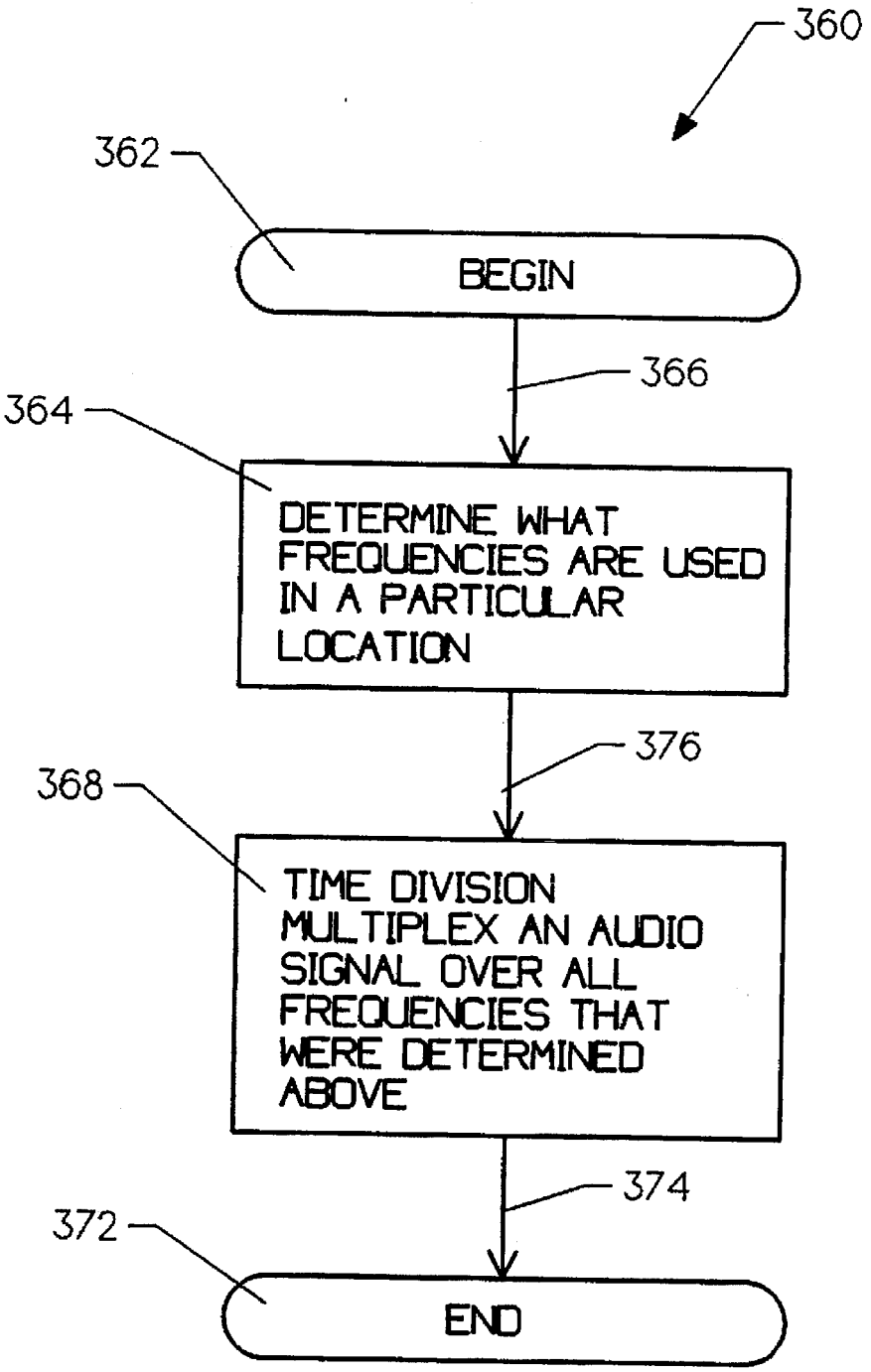
FIG. 8 is a flow diagram showing the operation of a second illustrative embodiment of the present invention.

FIG. 8 is a flow diagram showing the operation of a second illustrative embodiment of the present invention. The flow diagram is generally shown at 360. The algorithm is entered at element 362, wherein control is passed to element 364 via interface 366. Element 364 determines what frequencies are active in a particular location. Control is then passed to element 368 via interface 370. Element 368 time division multiplexes an audio signal over all frequencies that were determined in element 364. Control is then passed to element 372 via interface 374, wherein the algorithm is exited.

Figure 9:
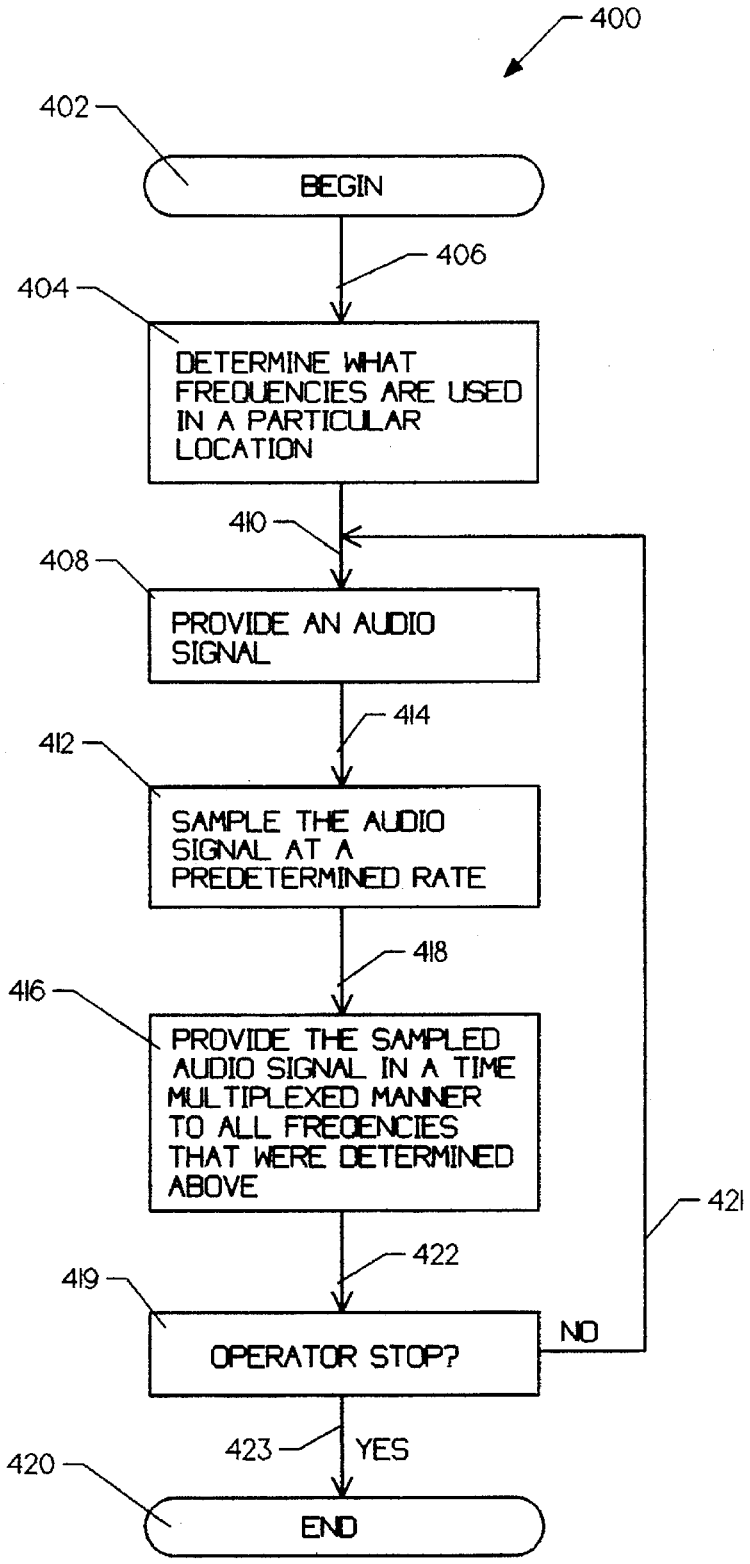
FIG. 9 is a detailed flow diagram showing the operation of the second illustrative embodiment of the present invention.

FIG. 9 is a detailed flow diagram showing the operation of the second illustrative embodiment of the present invention. The flow diagram is generally shown at 400. The algorithm is entered at element 402, wherein control is passed to element 404 via interface 406. Element 404 determines what frequencies are active in a particular location. Control is then passed to element 408 via interface 410. Element 408 provides an audio signal. Control is then passed to element 412 via interface 414. Element 412 samples the audio signal provided by element 408 at a predetermined rate. Control is then passed to element 416 via interface 418.

Element 416 provides the sampled audio signal in a time division multiplexed manner to all frequencies that were determined in element 404. Control is then passed to element 419 via interface 422. Element 419 determines whether an operator or the like has indicated a desire to stop the algorithm. If the operator or the like has not indicated a desire to stop the algorithm, control is passed back to element 408 via interface 421. Although it is not explicitly shown, it is also contemplated that control may be passed back to element 404, rather than element 408, wherein element 404 may determined what frequencies are used in the particular location. If the operator or the like has indicated a desire to stop the algorithm, control is passed to element 420 via interface 423, wherein the algorithm is exited.

Figure 10:
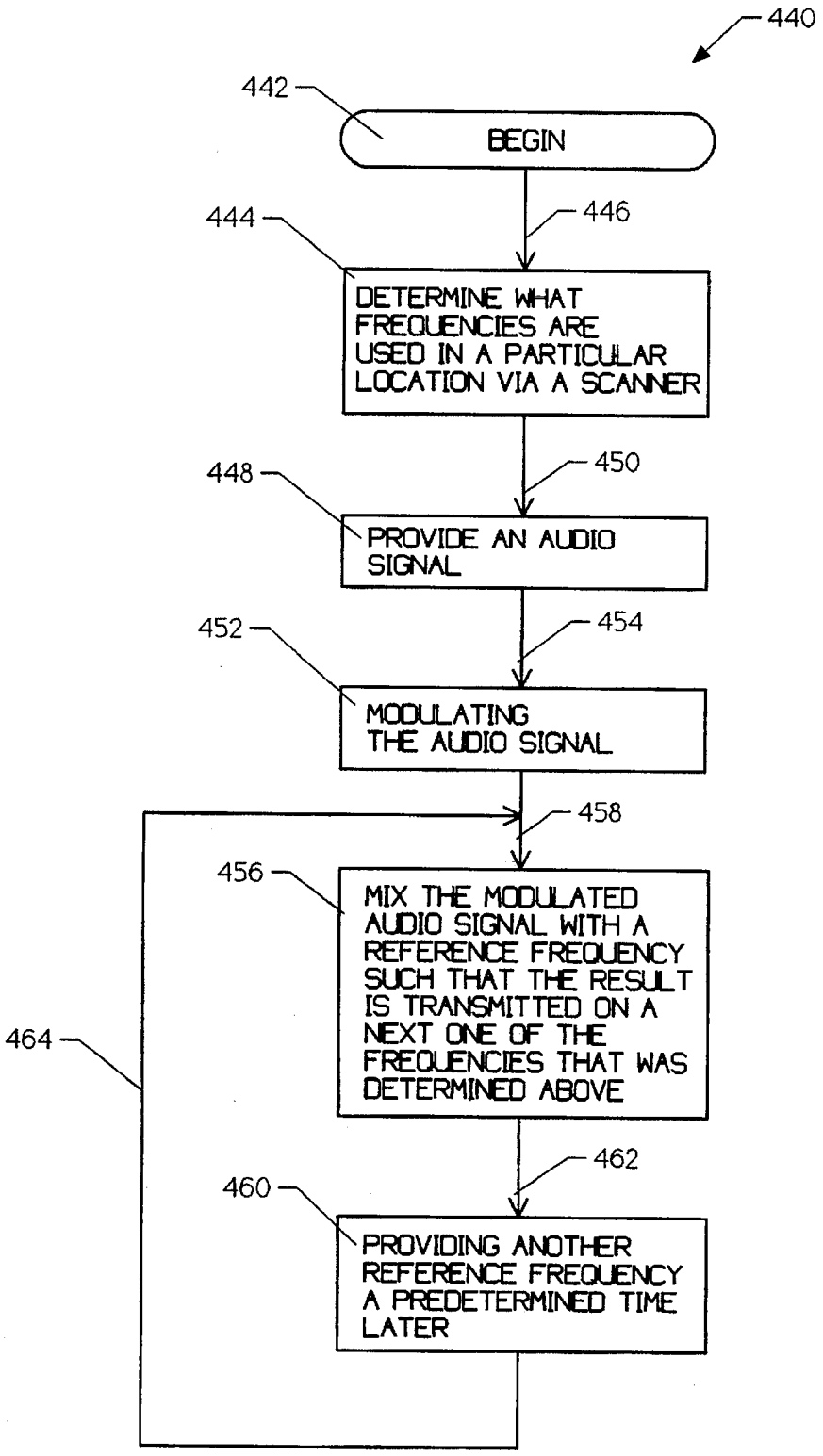
FIG. 10 is another detailed flow diagram showing the operation of the second illustrative embodiment of the present invention.

FIG. 10 is a detailed flow diagram showing another operation of the second illustrative embodiment of the present invention. The detailed flow diagram is generally shown at 440. The algorithm is entered at element 442, wherein control is passed to element 444 via interface 446. Element 444 determines what frequencies are active in a particular location via a scanner. Control is then passed to element 448 via interface 450. Element 448 provides an audio signal. Control is then passed to element 452 via interface 454. Element 452 modulates the audio signal provided by element 448. Control is then passed to element 456 via interface 458. Element 456 mixes the modulated audio signal provided by element 452 with a reference frequency such that the result is transmitted on a next one of the frequencies that was determined in element 444. Control is then passed to element 460 via interface 462. Element 460 provides another reference frequency a predetermined time later. Control is then passed back to element 456 via interface 464.

Figure 11:
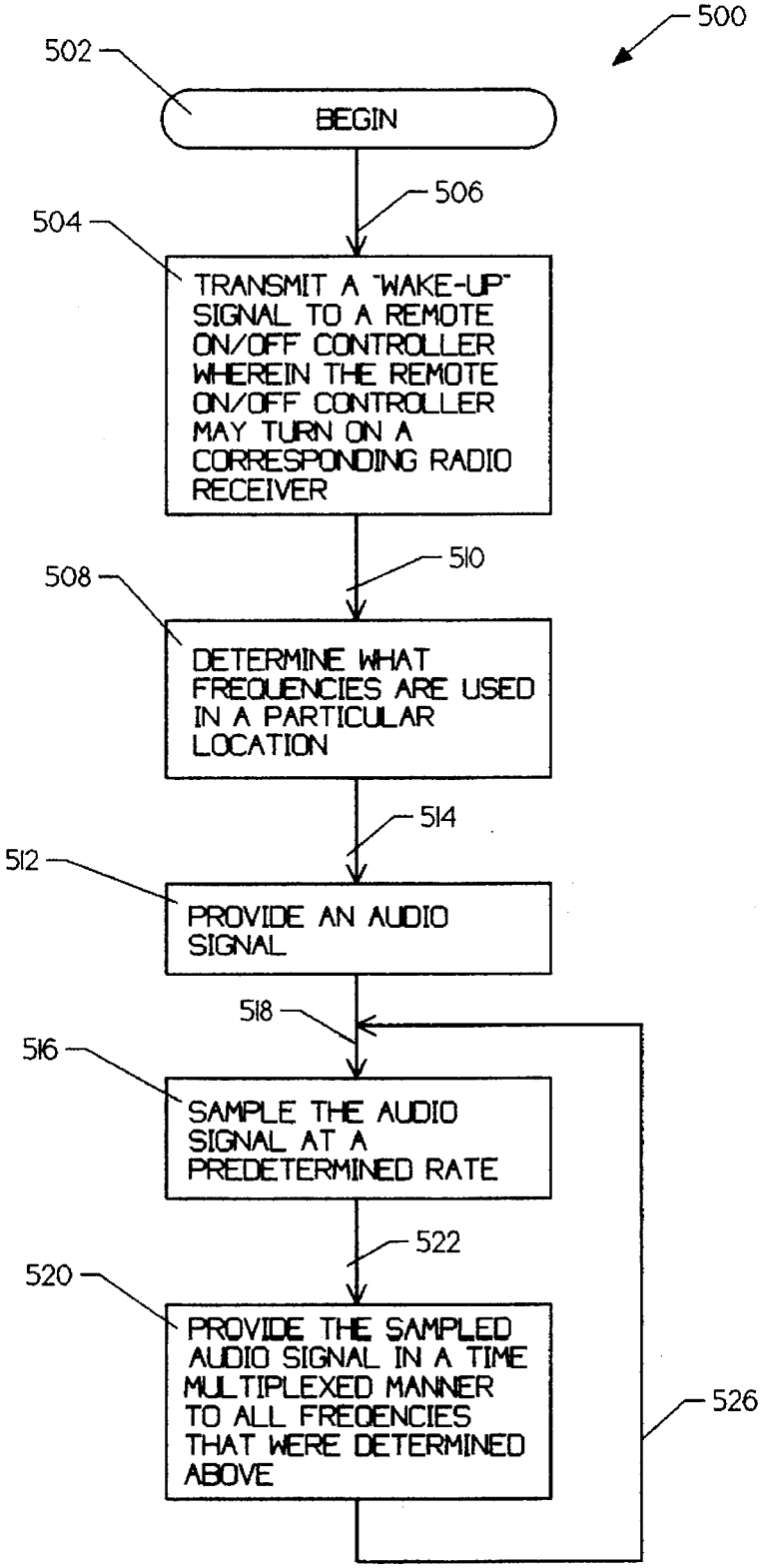
FIG. 11 is a flow diagram showing the operation of a third illustrative embodiment of the present invention.

FIG. 11 is a flow diagram showing the operation of a third illustrative embodiment of the present invention. The flow diagram is generally shown at 500. The algorithm is entered at element 502, wherein control is passed to element 504 via interface 506. Element 504 transmits a "wake-up" signal to a remote on/off controller, wherein the remote on/off controller may turn on a corresponding radio receiver. Control is then passed to element 508 via interface 510. Element 508 determines what frequencies are active in a particular location. Control is then passed to element 512 via interface 514. Element 512 provides an audio signal. Control is then passed to element 516 via interface 518. Element 516 samples the audio signal provided by element 512 at a predetermined rate. Control is then passed to element 520 via interface 522. Element 520 provides the sampled audio signal provided by element 516 in a time division multiplexed manner to all frequencies that were determined in element 508. Control is then passed back to element 516 via interface 526. Although it is not explicitly shown, it is also contemplated that control may be passed back to element 508 or element 514, rather than element 516 as shown.

Having thus described the preferred embodiments of the present invention, those of skill in the art will readily appreciate that the teachings found herein may be applied to yet other embodiments within the scope of the claims hereto attached.

What is claimed is:

1. An emergency radio transmission system for operating at a location wherein a number of remote transmitters are collectively transmitting a number of remote signals on a number of selected frequencies, the emergency radio transmission system comprising:

a. frequency determining means for determining the number of selected frequencies at the location; and b. transmitting means operative in combination with said frequency determining means for transmitting a local signal on said number of selected frequencies.

2. An emergency radio transmission system according to claim 1 wherein said transmitting means transmits said local signal on said number of selected frequencies in a sequential manner.

3. An emergency radio transmission system according to claim 1 wherein said transmitting means time division multiplexes (TDM) said local signal thereby providing a TDM signal, said transmitting means transmitting said TDM signal on said number of selected frequencies.

4. An emergency radio transmission system according to claim 1 wherein said transmitting means further comprises:

a. modulation means for modulating said local signal and for providing a modulated signal therefrom;

b. frequency control means coupled to said frequency determining means for stepping a reference frequency signal through a plurality of pre-mix frequencies at a predetermined rate, each of said plurality of pre-mix frequencies corresponding to one of said selected frequencies;

c. mixing means coupled to said modulation means and further coupled to said frequency control means for mixing said modulated signal and said reference frequency signal, and for providing a post-mix signal therefrom; and amplifier means coupled to said mixing means for amplifying and transmitting said post-mix signal.

5. An emergency radio transmission system according to claim 4 wherein said frequency control means comprises:

a. direct digital synthesizer means coupled to said mixing means for providing said reference frequency signal to said mixing means; and b. control means coupled to said direct digital synthesizer means for controlling the predetermined rate of stepping said reference frequency signal through said plurality of pre-mix frequencies and for controlling said plurality of pre-mix frequencies.

6. An emergency radio transmission system according to claim 5 wherein said direct digital synthesizer comprises:

a. a memory element having an address input and a data output;

b. a full adder having at least one predetermined most significant bit(s), said at least one predetermined most significant bit(s) being provided to said address input of said memory element, said full adder having an operand input wherein said operand input is coupled to said control means; and c. a digital-to-analog converter coupled to said data output of said memory element.

7. An emergency radio transmission system according to claim 4 wherein said modulation means comprises an FM modulator.

8. An emergency radio transmission system according to claim 4 wherein said modulation means comprises an AM modulator.

9. An emergency radio transmission system according to claim 4 wherein said frequency determining means comprises a scanner.

10. An emergency radio transmission system according to claim 4 wherein said frequency determining means comprises a terminal.

11. An apparatus for transmitting a selected signal from a first vehicle to a second vehicle comprising:

a. a frequency selection element for selecting a plurality of frequencies which are active at a particular location;

b. a modulation element for modulating the selected signal and for providing a modulated signal therefrom;

c. a frequency control element coupled to said frequency selection element and further coupled to said modulation element for stepping a reference frequency signal through a plurality of pre-mix frequencies at a predetermined rate, each of said plurality of pre-mix frequencies corresponding to one of said plurality of selected frequencies;

d. a mixing element coupled to said modulation element and further coupled to said frequency control element for mixing said modulated signal and said reference frequency signal, and for providing a post-mix signal therefrom; and e. a transmitting element coupled to said mixing element for transmitting said post-mix signal from said first vehicle to said second vehicle.

12. An apparatus according to claim 11 wherein said frequency control element steps said reference frequency signal through said plurality of pre-mix frequencies at a predefined rate such that said selected signal is transmitted over each of said plurality of selected frequencies in a sequential manner.

13. An apparatus according to claim 11 wherein said frequency control element steps said reference frequency signal through said plurality of pre-mix frequencies at a rate which is at or above the Nyquist rate for said selected signal, said mixing circuit thereby time division multiplexing (TDM) said selected signal and providing a TDM signal, said transmitting element transmitting said TDM signal on said plurality of selected frequencies.

14. An apparatus according to claim 11 wherein said second vehicle comprising a remote on/off controller for turning on a corresponding radio receiver.

15. A method for providing a local signal from a first vehicle having a location to a second vehicle wherein a number of remote transmitters are collectively transmitting a number of remote signals on a number of selected frequencies at the location of the first vehicle, the method comprising the steps of:

a. determining the selected frequencies of the remote signals at the location of the first vehicle, said determining step providing a plurality of preselected frequencies; and b. sending said local signal over said plurality of preselected frequencies to said second vehicle.

16. A method for providing a local signal from a first vehicle having a location to a second vehicle wherein a number of remote transmitters are collectively transmitting a number of remote signals on a number of selected frequencies at the location of the first vehicle, the method comprising the steps of:

a. determining the selected frequencies of the remote signals at the location of the first vehicle, said determining step providing a plurality of preselected frequencies;

b. sending said local signal over a first one of said plurality of preselected frequencies to said second vehicle;

c. sending said local signal over a next one of said plurality of preselected frequencies to said second vehicle;

d. ascertaining if said local signal has been sent over all of said plurality of preselected frequencies; and e. repeating step (c) if said ascertaining step concludes that said local signal has not been sent over all of said plurality of preselected frequencies.

17. A method for providing a local signal from a first vehicle havinq a location to a second vehicle wherein a number of remote transmitters are collectively transmitting a number of remote signals on a number of selected frequencies at the location of the first vehicle, the method comprising the steps of:

a. determining the selected frequencies of the remote signals at the location of the first vehicle, said determining step providing a plurality of preselected frequencies; and b. time division multiplexing said local signal over all of said plurality of preselected frequencies.

18. A method for providing a local signal from a first vehicle having a location to a second vehicle wherein a number of remote transmitters are collectively transmitting a number of remote signals on a number of selected frequencies at the location of the first vehicle, the method comprising the steps of:

a. determining the selected frequencies of the remote signals at the location of the first vehicle, said determining step providing a plurality of preselected frequencies;

b. sampling said local signal at a predetermined rate thereby providing a sampled signal; and c. time division multiplexing said sampled signal over all of said plurality of preselected frequencies.

19. A method according to claim 18 further comprising the steps of:

a. providing a remote on/off controller in said second vehicle wherein said remote on/off controller is coupled to a corresponding radio receiver; and b. providing a "wake-up" signal to said remote on/off controller wherein said remote on/off controller turns on said corresponding radio receiver.

20. A method for providing a local signal from a first vehicle having a location to a second vehicle, comprising:

a. determining the frequencies of a number of remotely generated signals that are active at the location of the first vehicle, said determining step (a) providing a plurality of preselected frequencies;

b. modulating said local signal thereby providing a modulated signal;

c. mixing said modulated signal with a reference frequency signal thereby providing a post-mix signal having a frequency, said reference frequency signal having a corresponding frequency associated therewith, said frequency of said reference frequency being such that the frequency of said post-mix signal corresponds to one of said plurality of preselected frequencies;

d. providing a next reference frequency signal having a next corresponding frequency associated therewith, said next frequency of said next reference frequency signal being such that the resulting post-mix signal corresponds to the next one of said plurality of preselected frequencies; and e. repeating steps (c) and (d).

21. A method for providing a signal over a number of frequencies, wherein the signal has a corresponding Nyquist sample rate, the method comprising the steps of:

a. sampling the signal at or above the Nyquist sample rate of the signal, wherein the sampling step samples the signal during a number of sample periods;

a. providing the signal over a first one of the number of frequencies during a first one of the number of sample periods; and c. providing the signal over a second one of the number of frequencies during a second one of the number of sample periods.

* * * * *